US008256201B2

(12) United States Patent
Beckers et al.

(10) Patent No.: US 8,256,201 B2
(45) Date of Patent: Sep. 4, 2012

(54) YARN BRAKE FOR A TWO-FOR-ONE TWISTING SPINDLE

(75) Inventors: Joachim Beckers, Mönchengladbach (DE); Markus Beckmann, Krefeld (DE); Ingo Filz, Viersen (DE); Heinz Fink, Krefeld (DE); Jürgen Schnitzler, Viersen (DE)

(73) Assignee: Oerlikon Textile GmbH & Co. KG, Remscheid (DE)

( * ) Notice: Subject to any disclaimer, the term of this patent is extended or adjusted under 35 U.S.C. 154(b) by 1 day.

(21) Appl. No.: 12/962,715

(22) Filed: Dec. 8, 2010

(65) Prior Publication Data

US 2011/0146221 A1 Jun. 23, 2011

(30) Foreign Application Priority Data

Dec. 18, 2009 (DE) ..... 10 2009 058 979

(51) Int. Cl.
*D01H 15/007* (2006.01)

(52) U.S. Cl. ..... 57/279

(58) Field of Classification Search ..... 57/58.49, 57/58.86, 279
See application file for complete search history.

(56) References Cited

U.S. PATENT DOCUMENTS

| | | | | | |
|---|---|---|---|---|---|
| 4,287,712 | A | * | 9/1981 | Franzen et al. | 57/279 |
| 4,355,500 | A | * | 10/1982 | Yanobu et al. | 57/279 |
| 4,391,090 | A | * | 7/1983 | Charbonnier | 57/279 |
| 4,642,980 | A | * | 2/1987 | Fukunaga et al. | 57/58.86 |
| 4,711,081 | A | | 12/1987 | Frentzel-Beyme et al. | |
| 4,782,653 | A | * | 11/1988 | Yanobu | 57/279 |
| 5,155,988 | A | * | 10/1992 | Nieratschker | 57/279 |
| 5,581,988 | A | * | 12/1996 | Fink et al. | 57/58.86 |
| 6,347,505 | B2 | * | 2/2002 | Scheufeld | 57/58.86 |
| 6,401,443 | B2 | | 6/2002 | Scheufeld | |

FOREIGN PATENT DOCUMENTS

| | | | |
|---|---|---|---|
| DE | 8110891 | B2 | 8/1982 |
| DE | 3605193 | C1 | 7/1987 |
| DE | 10032141 | A1 | 1/2002 |

* cited by examiner

*Primary Examiner* — Shaun R Hurley
(74) *Attorney, Agent, or Firm* — K&L Gates LLP

(57) ABSTRACT

A yarn brake for a two-for-one twisting spindle has a brake element mounted in the region of a hollow axle of the spindle between an upper and a lower brake face, the braking force being predeterminable in a defined manner by means of the pretensioning of at least one spring element, which acts on an axially displaceably mounted upper piston, in which the upper brake face is integrated, and the yarn brake being pneumatically releasable to introduce a yarn. The upper piston (27) receiving the upper brake face (28) is configured in such a way and guided with play (S) within a housing (16) of the yarn brake (14) in such a way that it can move aside if necessary into a position (I), in which its center longitudinal axis (37) forms an angle (α) with the center longitudinal axis (38) of the housing (16).

15 Claims, 8 Drawing Sheets

YARN BRAKE FOR A TWO-FOR-ONE TWISTING SPINDLE

CROSS-REFERENCE TO RELATED APPLICATIONS

This application claims the benefit of German patent application 10 2009 058 979.1, filed Dec. 18, 2009, herein incorporated by reference.

FIELD OF THE INVENTION

The invention relates to a yarn brake for a two-for-one twisting spindle.

BACKGROUND OF THE INVENTION

Yarn brakes for two-for-one twisting spindles have been known for a long time in various configurations and are described, sometimes in detail, in numerous patents. Yarn brakes of this type are, in particular, used in two-for-one twisting processes and ensure that the yarn receives a specific pretensioning during the twisting process.

A two-for-one twisting spindle with a yarn brake, which is configured as a brake cartridge, is known, for example, from DE 31 39 236 C2. In yarn brakes of this type configured as brake cartridges, two cylinders pressed apart from one another by a spring element and slidable telescopically relative to one another are supported by their spherical ends on brake faces, which are arranged in the region of a yarn inlet opening or a yarn outlet opening of a brake housing and, in the process, clamp the yarn that is traveling through the brake housing.

The drawback in brake cartridges of this type is, however, that the pretensioning of the yarn during the twisting process is only predetermined by the spring force of the spring element of the brake cartridge and, at least during the twisting process, cannot be corrected. Furthermore, brake devices for two-for-one twisting spindles are known, for example, from German Patent Publication DE 33 36 715 C2 or U.S. Pat. No. 7,000,865 B1, which in each case have a ball which rests in a brake housing on a brake face. In this type of brake device, the braking force acting on the yarn that is traveling through the brake housing is dependent on the ball's own weight; in other words, the pretensioning of the yarn can be adjusted up to a certain extent by the diameter of the ball. In brake devices configured in this manner, the achievable braking force is relatively low in each case, however. In order to be able to realize higher pretensionings, it has therefore already been proposed that a plurality of ball brakes of this type be arranged one behind the other. German Patent Publication DE 197 55 825 A1 describes a two-for-one twisting spindle for twisting natural silk, the yarn brake of which has a total of seven brake ball devices arranged one behind the other. Brake devices of this type not only require a relatively large installation space, but are extremely disadvantageous with regard to threading a new yarn.

Yarn brakes for two-for-one twisting spindles are also known from German Patent Publication DE-GM 81 10 891, in which an upper piston, which is loaded by a spring element and is equipped with a first upper brake face, acts on a brake ball, which is thereby in turn pressed onto a second, lower brake face. By rotating a spring element abutment, the pretensioning of the spring element and therefore the contact pressure of the brake ball on the brake faces can thus be adjusted in a defined manner. In this known yarn brake, the brake ball can also be raised pneumatically, which considerably facilitates the threading of a new yarn into the yarn brake.

The drawback in this type of yarn brake is, however, that the spring-loaded piston, which has the upper brake face, slides virtually without play in an axial guide of the yarn brake housing. In other words, the upper brake face cannot move away laterally, which leads to the fact that yarn anomalies such as knots, thick locations, lumps of dust, etc., lead to strong yarn tension increases through to yarn breaks.

SUMMARY OF THE INVENTION

In view of the aforementioned prior art, it is an object of the present invention to develop a yarn brake for a two-for-one twisting spindle, which is configured to substantially avoid yarn tension increases, which could lead to a yarn break.

This object is addressed in accordance with the present invention by a yarn brake for a two-for-one twisting spindle having a brake element mounted in the region of a hollow axle of a spindle between an upper and a lower brake face, wherein the braking force is predeterminable in a defined manner by means of the pretensioning of at least one spring element, which acts on an axially displaceably mounted upper piston, in which the upper brake face is integrated, and wherein the yarn brake is pneumatically releasable to introduce a yarn. According to the present invention, the upper piston receiving the upper brake face is configured in such a way and is guided with play within a housing of the yarn brake in such a way that it can move aside if necessary into a position, in which its center longitudinal axis forms an angle with the center longitudinal axis of the housing, which has the advantage that the upper piston automatically reacts to yarn anomalies. In other words, when yarn anomalies occur, at least the upper brake face integrated into the upper piston immediately moves away slightly to the side.

Undesired yarn tension increases, in particular yarn breaks, are thus already reliably avoided from the outset of a twisting operation.

An advantageous embodiment of the invention provides that the angle, which is adjusted upon the occurrence of yarn anomalies between the center longitudinal axis of the upper piston and the center longitudinal axis of the housing of the yarn brake, is up to 10°. By means of such a relatively small tilting angle, on the one hand, the structural outlay in the region of the yarn brake can be minimized, but it can nevertheless be ensured that the occurrence of high yarn tensions is avoided when, for example, knots, thick locations or lumps of dust run over the upper brake face.

According to additional features of the invention, it is made possible for the upper piston to move away when yarn anomalies occur in that the upper piston is equipped with guide lugs, which allow a certain lateral displacement of the piston. The upper piston, for example, has a disc-shaped lower guide lug, the diameter of which is below the internal diameter of the housing in the working region of the guide lug. Furthermore, the upper piston has a preferably circular upper guide face, the internal diameter of which is above the external diameter of the hollow axle of the two-for-one twisting spindle.

A configuration of this type, on the one hand, ensures clean guidance of the upper piston in the housing of the yarn brake during "normal" twisting operation and, on the other hand, if necessary allows an immediate, reliable moving away of the upper brake face.

At least the disc-shaped lower guide lug has a convexly curved, peripheral guide face in an advantageous configuration. A convexly curved guide face of this type, on the one hand, favors the tilting capacity of the piston and, on the other hand, reliably prevents the piston being able to be jammed in the housing. Overall, a convexly curved, peripheral guide face, when necessary, has a positive effect on the functioning of the yarn brake.

It is provided in an advantageous configuration that the upper piston is loaded by two spring elements arranged one behind the other, which in each case have different spring characteristics and the pretensioning of which can be adjusted in a defined manner by a rotatably mounted abutment device. The abutment device in this case has helically arranged latching positions, which can be easily engaged by corresponding rotation of the abutment device in the housing of the yarn brake.

The lower brake face, on which the brake element is pressed, may be integrated in a lower piston, which, loaded by a spring element, is positioned in a working position and can be pneumatically lowered into a threading position to yarn a new yarn. A configuration of this type considerably facilitates the threading of a new yarn.

It is provided in a first advantageous embodiment that a support element, which is movably mounted to a limited extent in the axial direction, is arranged in the region of the brake element. This support element is positioned during the twisting operation by the lower piston in a rest position and, during the lowering of the lower piston into its threading position, slides into an intermediate position. The support element also has an oblique plane to guide the brake element. When the lower piston is lowered and therefore during the movement of the support element into its intermediate position, the brake element automatically slides on the oblique plane into an eccentrically arranged position. The eccentric position is predetermined here by a receiving pocket which is let into the lower piston. In other words, the brake element, during the threading of a new yarn, neither has contact with the upper brake face nor with the lower brake face, but is located, spaced apart from the brake faces and outside the yarn travel of new yarns, in a receiving pocket of the lower piston. As can be seen without difficulty, a configuration of this type reliably ensures that the through-suction of new yarns by the yarn brake is not at all impeded.

It is provided in an alternative embodiment that a support element is installed in the region of the brake element on the housing. The brake element is placed on this stationary support element when the lower piston is lowered into its threading position.

The support element is, in this case, configured in such a way that even with the brake element resting thereon there is adequate space between the support element and brake element for it to also be ensured in this embodiment that new yarns can be threaded without problems.

It is also provided in an advantageous configuration that both the brake element configured as a brake ball and the brake faces are manufactured from a material which is very abrasion-resistant. In other words, the brake ball and/or the brake faces may, for example, consist of hardened steel, which is a relatively economical construction, or the brake ball and/or the brake faces may be manufactured from an oxide-ceramic material. Oxide-ceramic materials of this type, as is known, are distinguished by great hardness and are accordingly very abrasion-resistant.

BRIEF DESCRIPTION OF THE DRAWINGS

The invention will be described in more detail below with the aid of an embodiment shown in the drawings, in which.

DETAILED DESCRIPTION OF THE PREFERRED EMBODIMENTS

Figure 1:
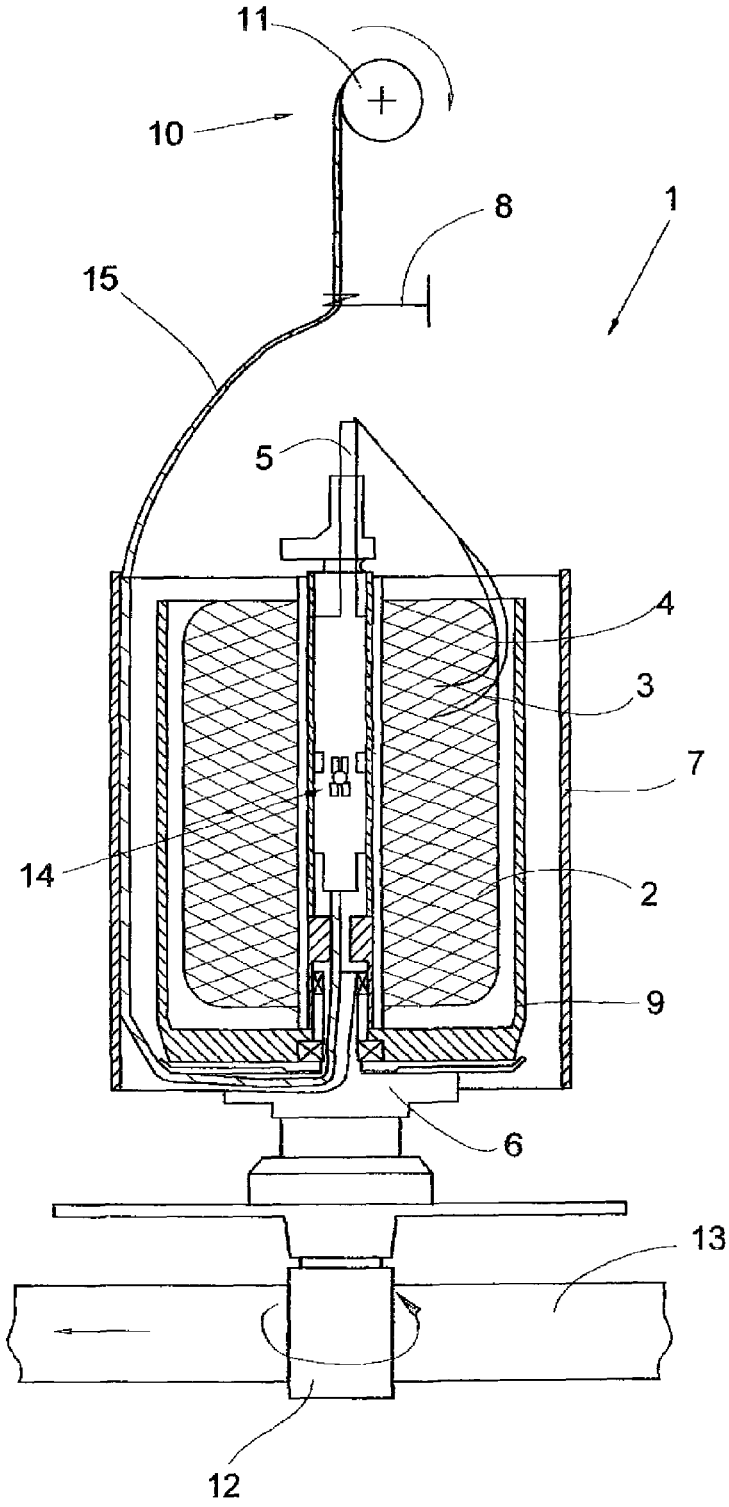
FIG. 1 shows a two-for-one twisting spindle with a yarn brake according to the invention arranged in the region of the hollow axle of the spindle.

FIG. 1 schematically shows, partially in section, a two-for-one twisting spindle designated as a whole by the reference numeral 1. A yarn or a plurality of yarns, are provided with a twist by a two-for-one twisting spindle 1 of this type. This provision of a twist is used to increase the quality of the yarn/yarns, for example with regard to the tearing strength and therefore improved further processability in subsequent processes, such as, for example, weaving, knitting, tufting and the like.

The actual double twist process in this case proceeds as follows. As shown in the embodiment of FIG. 1, yarns 3 and 4 are unwound, for example, from a supply bobbin 2, which is mounted in a stationary protection pot 9 and drawn from above into the hollow axle 5 of the two-for-one twisting spindle 1. When crossing the hollow axle 5, the yarns 3 and 4 are twisted by a rotatably mounted spindle part 6, which is arranged below the protection pot 9, deflected in an L-shaped manner and arrive, preferably sliding upward in a balloon shape on a sheathing 7 acting as a balloon limiter, at a stationary balloon yarn guide 8, in order to then be wound on a winding device 10, as now twisted yarn 15, to form a bobbin 11. As shown in FIG. 1, the spindle part 6 in the embodiment has a wharve 12 at the end, which is made to rotate by means of frictional engagement by a tangential belt 13.

In order to allow the twisting process to proceed without disruption, a yarn brake 14 according to the invention, which pre-brakes the yarn 3, 4 that is traveling through the brake, is also installed in the region of the hollow axle 5 of the two-for-one twisting spindle 1. A pre-braking of this type is necessary in order to be able to form a yarn reserve in the region of a storage part of the spindle part 6, which is necessary for a disruption-free twisting process.

Figure 2A:
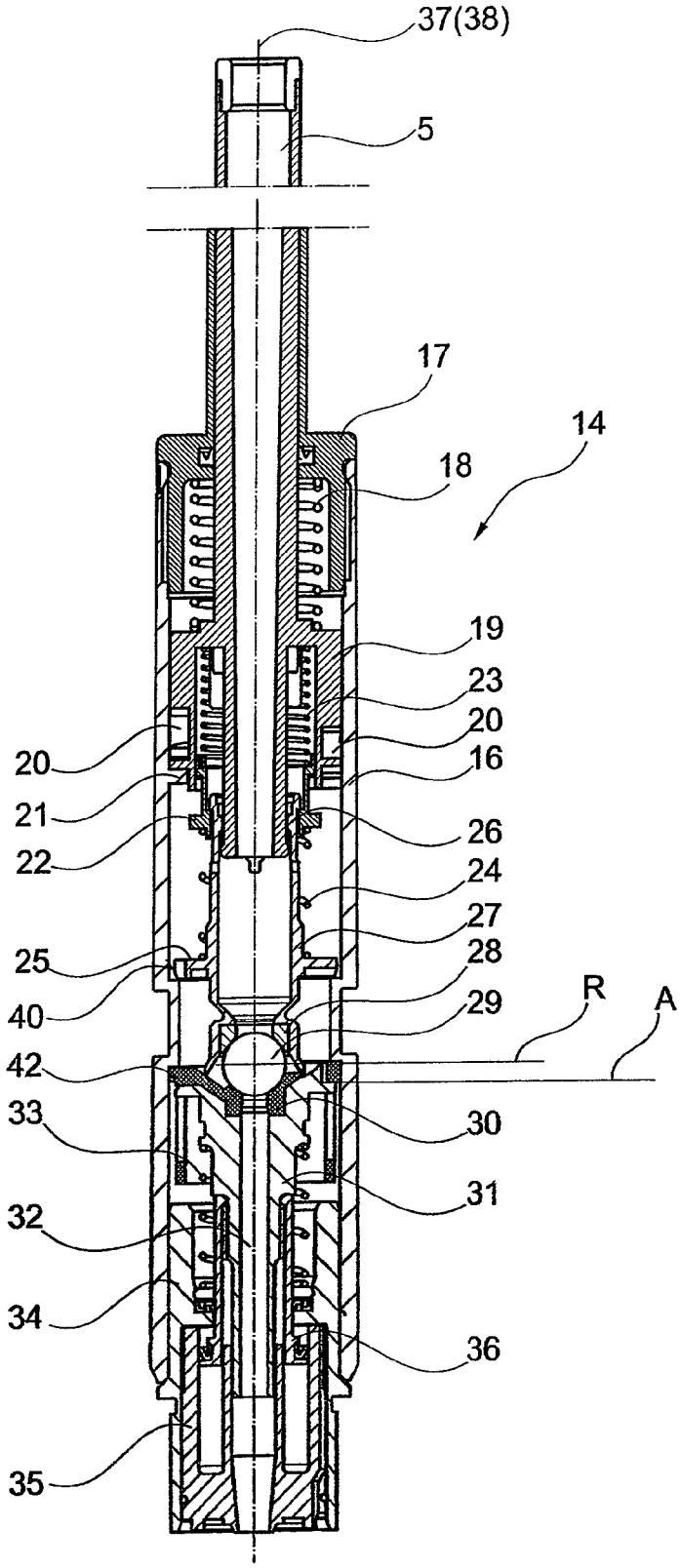
FIG. 2A shows the yarn brake according to the invention, indicated in FIG. 1, to a larger scale and in section, the lower piston being positioned in its working position.
Figure 2B:
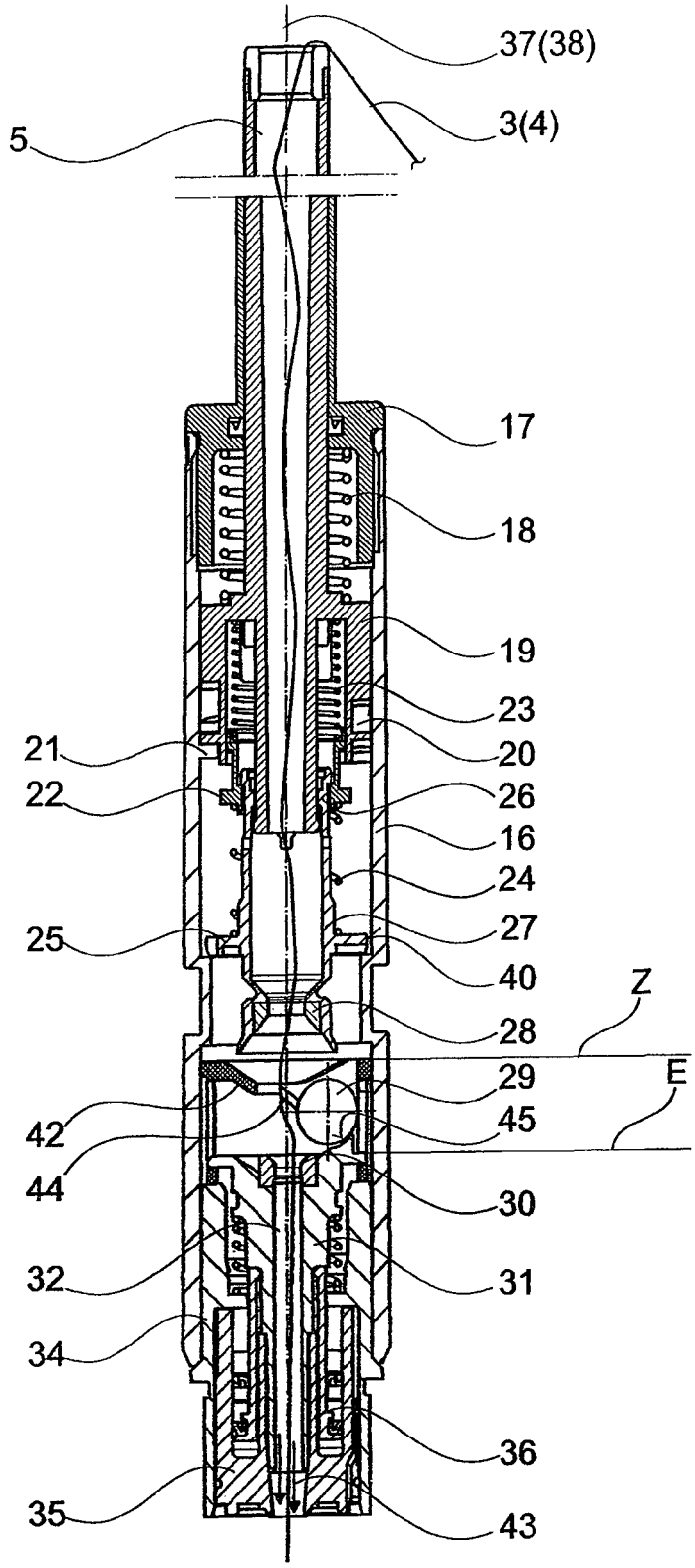
FIG. 2B shows the yarn brake shown in FIG. 2A, the lower piston and therefore the brake element are, however, positioned here in a threading position.

FIGS. 2A and 2B show a first advantageous embodiment of the yarn brake 14 according to the invention to a larger scale and in detail. FIG. 2A in this case shows the yarn brake 14 with a brake element 29 positioned in the working position A, while FIG. 2B shows the yarn brake 14 in the threading position E. As shown in FIGS. 2A and 2B, the yarn brake 14 has a tubular housing 16, which is provided both on its upper side and on its lower side with a respective internal screw yarn (not shown in more detail). Fastened in the housing 16 by means of the upper internal screw yarn is a cover 17, which, on the one hand, forms a guide for the hollow axle 5 and, on the other hand, an abutment for a first spring element 18 arranged inside the cover 17. This first spring element 18 loads a pot-like abutment element 19, which is guided on the inner wall of the housing 16, of the hollow axle 5, which abutment element is in turn equipped with a large number of helically arranged latching positions 20. These helically arranged latching positions 20 alternately correspond with a cam 21 stationarily arranged on the inner wall of the housing 16.

Figure 4:
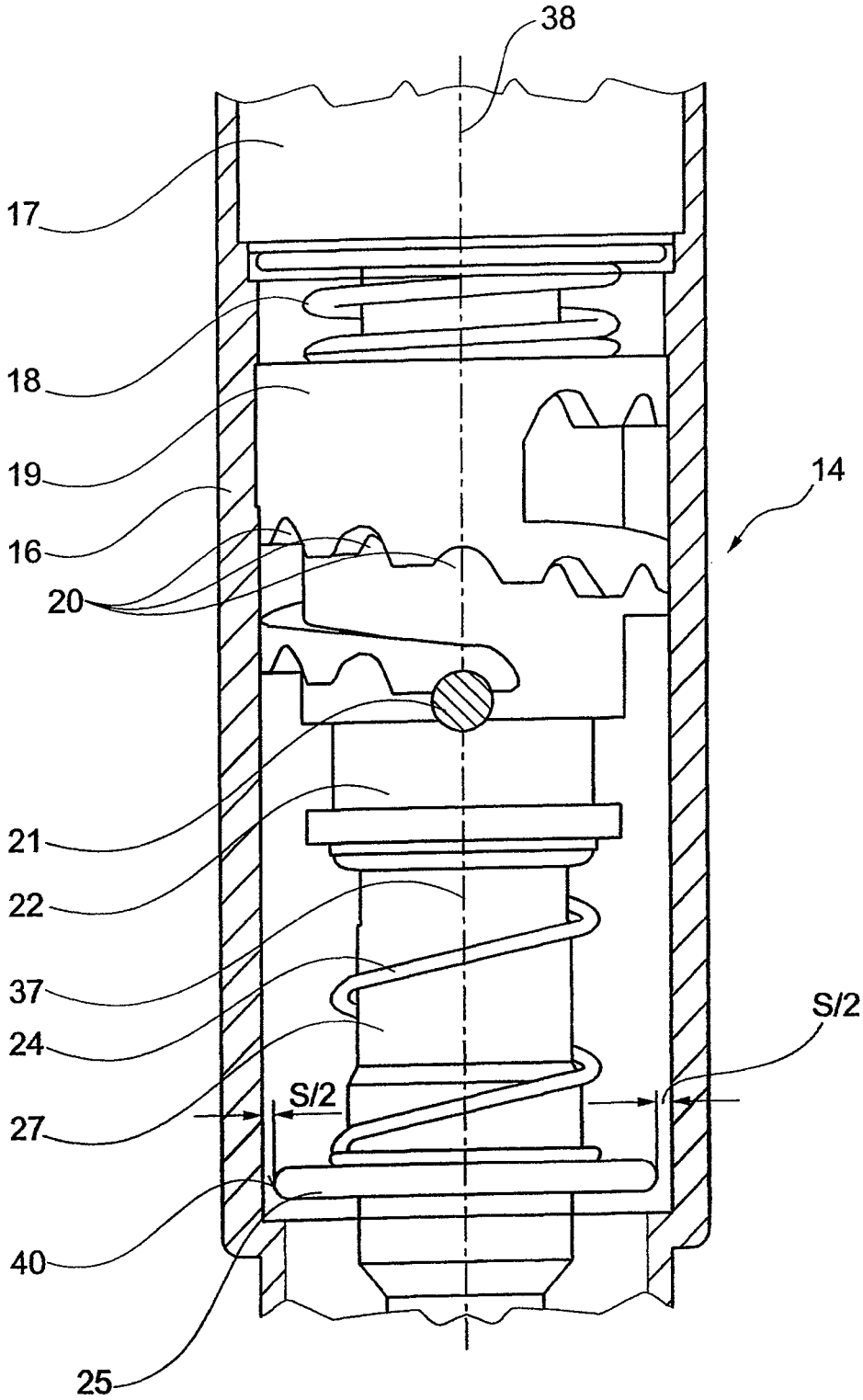
FIG. 4 shows, in section, a detailed view of the rotatably mounted abutment device of the yarn brake, which is used to adjust the pretensioning of the spring elements acting on the upper piston.

As can be seen, in particular, from FIG. 4, by corresponding rotation of the hollow axle 5, one of the respective helically arranged latching positions 20 can be positioned on the stationary cam 21 and therefore the axial position of the abutment element 19 in the housing 16 can be adjusted. As the axial position of the abutment element 19 predetermines the pretensioning of a second and a third spring element 23, 24, the braking force of the yarn brake 14 can be adjusted in a defined manner by means of the hollow axle 5. In other words, arranged in the interior of the abutment element 19 is a spring element 23, which corresponds with a sleeve 22, which is in turn guided on the inner wall of the abutment element 19.

Figure 3A:
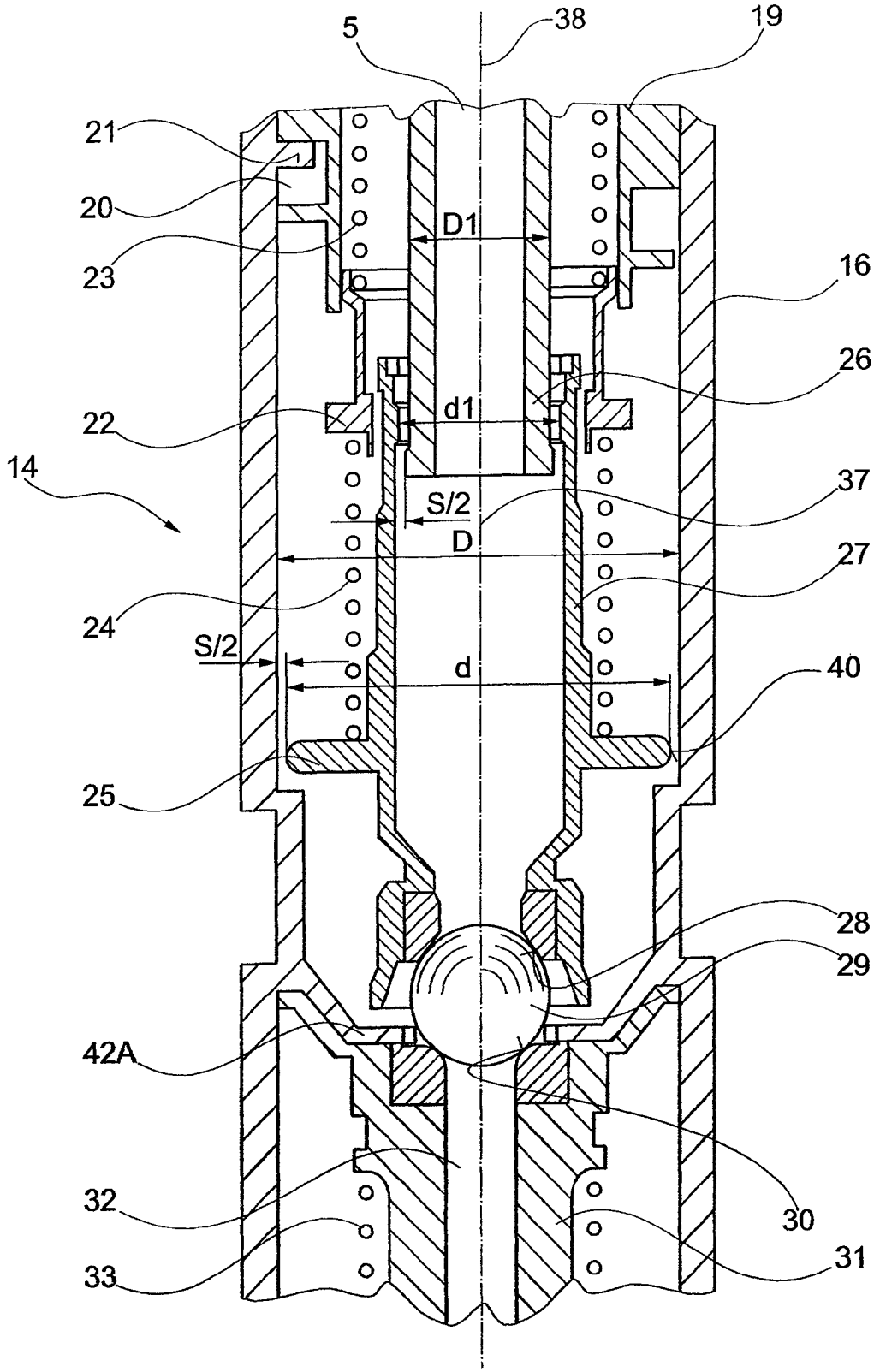
FIG. 3A shows a detail of a further embodiment of a yarn brake at a time at which no twisting process is running.

The spring element 24 is also connected between the sleeve 22 and a lower guide lug 25 of an upper piston 27. The upper piston 27 is mounted by guide lugs 25, 26 within the housing 16 of the yarn brake 14, the upper piston 27 being equipped with a lower guide lug 25, the external diameter d of which, as shown in FIG. 3A, is below the internal diameter D of the housing 16 in the working region of the piston 27, and also having an upper guide lug 26, the internal diameter $d_1$ of which is larger than the external diameter $D_1$ of the hollow axle 5. In other words, the upper piston 27 is mounted both in the region of the upper and in the region of the lower guide lug with play S. Furthermore, an annular insert manufactured from a wear-resistant material, for example hardened steel or an oxide ceramic material is fixed to the upper piston 27 and, in conjunction with a brake element 29, preferably a brake ball, forms an upper brake face 28. The brake ball 29, which is preferably also manufactured from a wear-resistant material, loaded by the spring force of the above-described spring elements 23, 24, also rests on a lower brake face 30.

Like the upper brake face 28, the lower brake face 30 is preferably also formed as an annular insert and manufactured from hardened steel or an oxide ceramic material. The lower brake face 30 is in this case arranged in a lower piston 31, which is positioned in its working position A during the twisting process by a fourth spring element 33 and has a lower hollow axle 32.

The spring element 33 positioning the lower piston 31 is supported on an intermediate insert 34, which is fixed in the lower internal screw yarn of the housing 16, and in turn receives a cover element 35, in which a pneumatic cylinder 36 which can be activated in a targeted manner, is mounted.

Figure 3B:
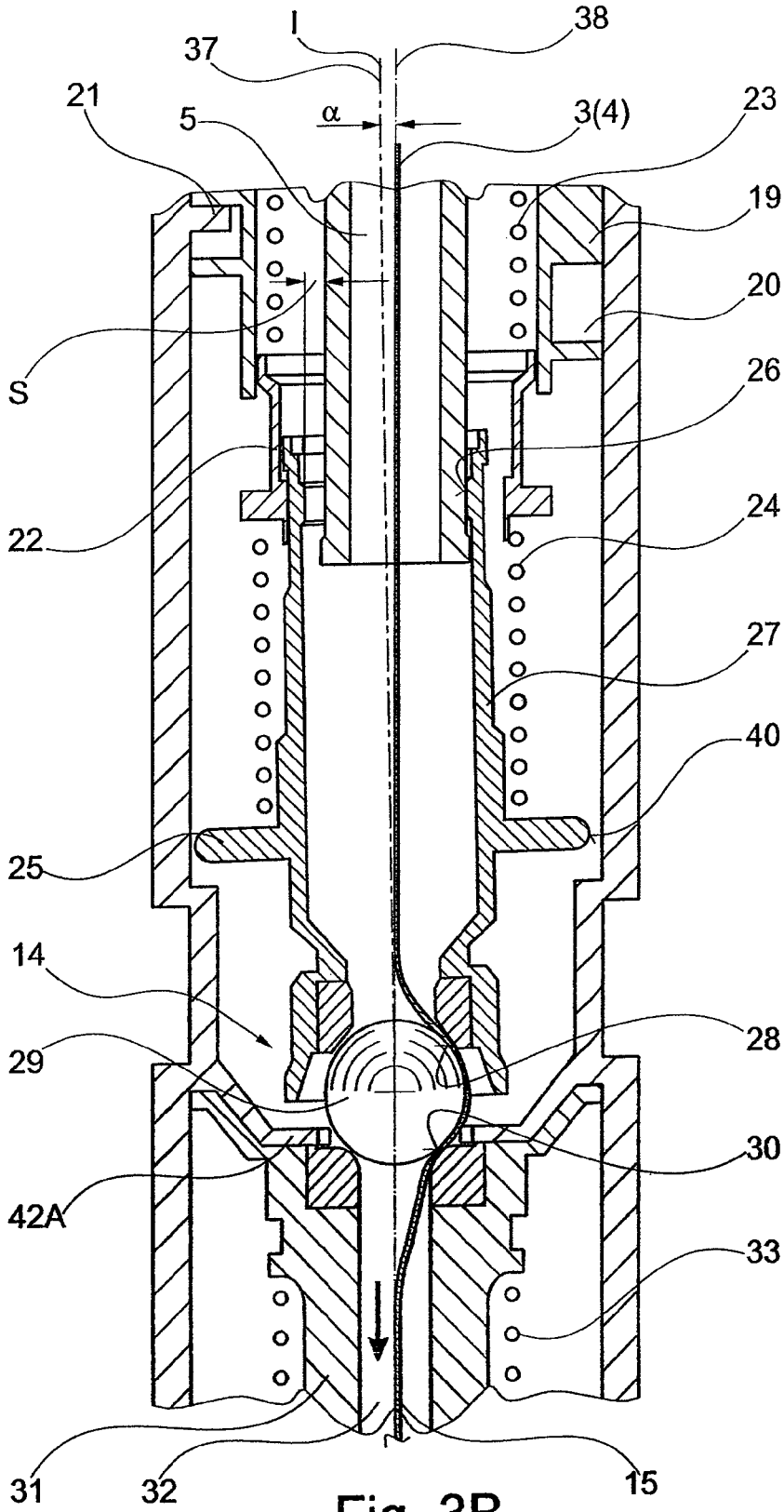
FIG. 3B shows the detail of the yarn brake shown in FIG. 3A, during the twisting process when a "normal" yarn is traveling through the brake.
Figure 3C:
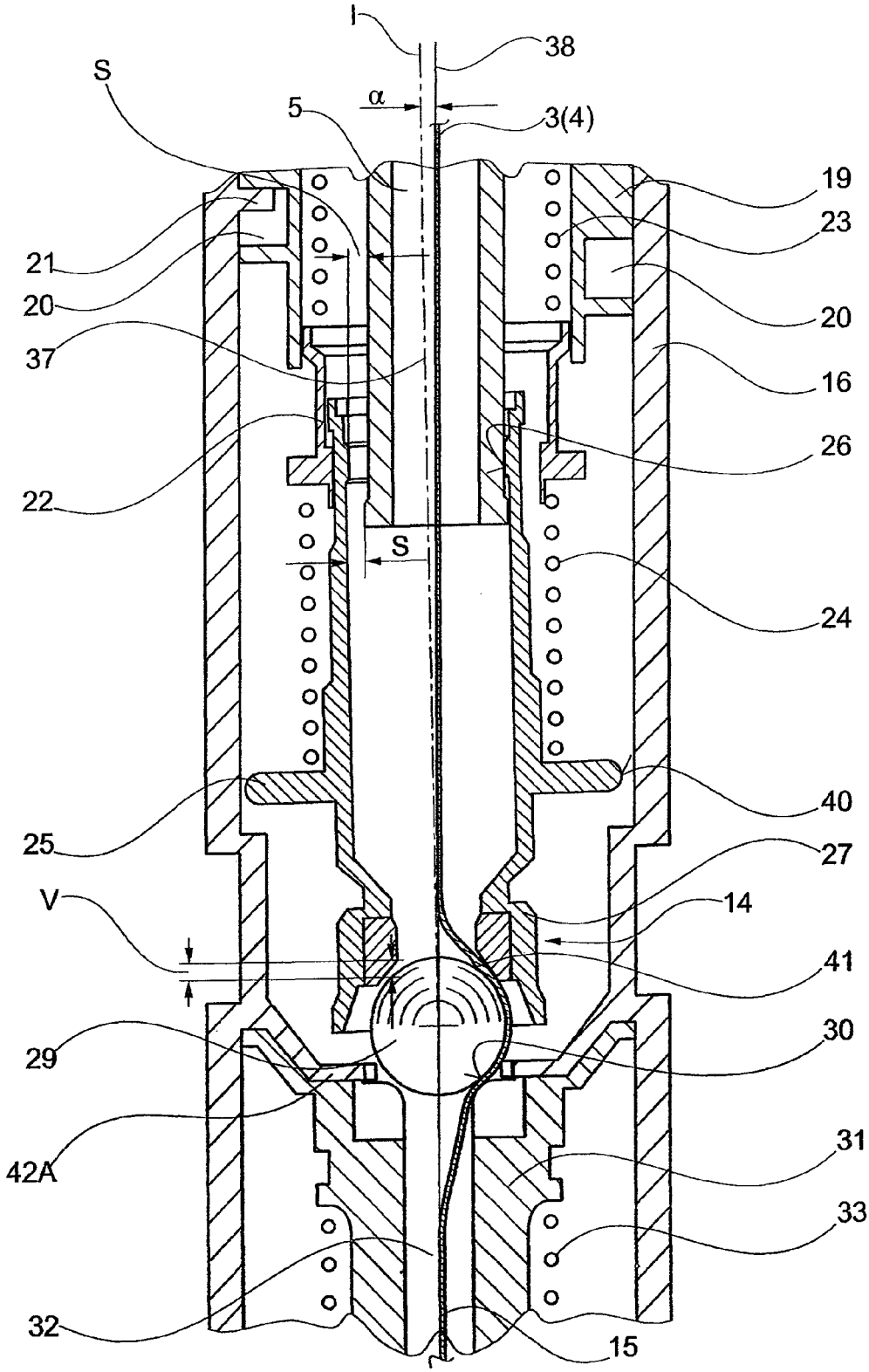
FIG. 3C shows a detail of the yarn brake shown in FIG. 3A, during the twisting process when a yarn anomaly is traveling through the brake.

As can be seen, in particular from FIGS. 3A to 3C, at least the lower guide lug 25 of the upper piston 27 has a convexly curved guide face 40, which allows the upper piston 27, in particular in conjunction with the play S provided in the region of the guide lugs 25, 26, to move away if necessary from the position shown in FIG. 3A, in which the center longitudinal axis 37 of the upper piston 27 and the center longitudinal axis 38 of the housing 16 extend in parallel, into one of the working positions, which are shown in FIGS. 3B and 3C.

FIG. 3B in this case shows the yarn brake 14 according to the invention during the "normal" twisting process. The yarns 3, 4 introduced into the hollow axle 5 of the two-for-one twisting spindle 1 are loaded with a predeterminable braking force, on the one hand, in the region of the upper brake face 28 and, on the other hand, in the region of the lower brake face 29 by the brake ball 29 and therefore provided with a pretensioning necessary for the twisting process. The yarns twisted to form a yarn 15 leave the yarn brake 14 through the lower hollow axle 32 of the lower piston. As shown in the embodiment of FIG. 3B, the upper piston 27 mounted with play S in the housing 16 is slightly tilted by the yarns 3, 4 running over the upper brake face 28. In other words the brake face 28 moves away slightly laterally, so between the center longitudinal axis 37 of the upper piston 27 and the center longitudinal axis 38 of the housing 16, a certain relatively small angle $\alpha$ is adjusted, which, on the one hand, depends on the yarn strength of the yarns 3, 4 and, on the other hand, on the respective yarn state.

When yarn anomalies occur, for example when, as shown in the embodiment of FIG. 3C, a relatively thick knot 41 reaches the upper brake face 28, the upper brake face 28 immediately moves away owing to tilting of the upper piston 27. The angle $\alpha$ being adjusted here between the center longitudinal axis 37 of the upper piston 27 and the center longitudinal axis 38 of the housing is, in this case, above the angle $\alpha$, which is produced during "normal" twisting operation. As shown in FIG. 3C, the upper brake face 28, depending on the thickness of the knot 41, is also raised by an amount V. The two movements described above of the upper piston 27 reliably prevent too high a yarn tension being able to build up because of a relatively thick knot 41, which would ultimately lead to a yarn break.

Figure 5:
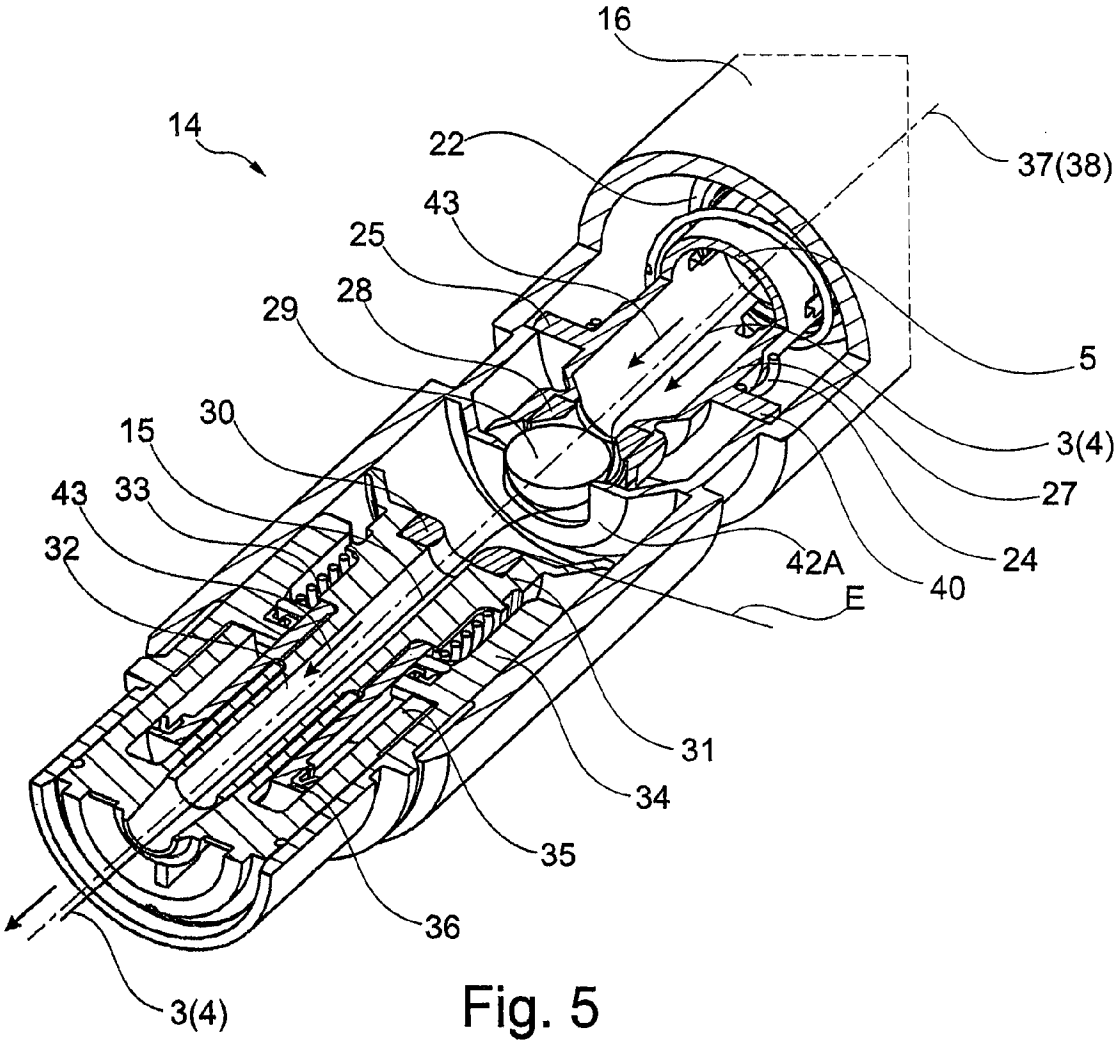
FIG. 5 shows, in section, a perspective view of a yarn brake open for threading a new yarn according to the embodiment shown in FIGS. 3A to 3C.

As shown in FIGS. 2B and 5, the yarn brake 14 can also be opened to yarn new yarns 3, 4.

In other words, the lower piston 31 and therefore the lower brake face 30 can be lowered by corresponding activation of the pneumatic piston 36 against the force of the spring element 33 out of the working position A into the threading position E. The brake ball 29 is released in the process from the upper brake face 28 and then slides, depending on the embodiment, either, as shown in FIG. 2B, over the oblique plane 44 of the support element 42 into a receiving pocket 45 in the lower piston 31, or the brake ball 29, as shown in FIG. 5, comes to rest, slightly spaced apart from the upper brake face 28, on a support element 42*a*, which is a component of the housing 16.

In the two embodiments, in this so-called threading position E, the lower brake face 30 is also positioned in such a way that when applying a negative pressure to the exit of the two-for-one twisting spindle 1 in the hollow axles 5 and 32 of the yarn brake 14 a negative pressure flow 43 is adjusted, which allows problem-free threading of new yarns 3, 4 into the yarn brake 14. After the yarns 3, 4 have been threaded, the pneumatic piston 36 is switched to pressureless. The spring element 33 then presses the lower piston 31 and therefore the lower brake face 30 into the working position A. During this action, the brake ball 29 is also again pressed onto the upper brake face 28, in other words, the yarn brake 14 is again located in its working position.

With regard to the spring elements 18, 23, 24, 33 it should be noted that spring elements are preferably used which have different characteristics. However, spring elements can also be used which have the same characteristics.

Furthermore, the spring elements can either, as shown in the present embodiments, be used in series operation, or else in parallel operation. The use of spring elements with progressive characteristics is certainly conceivable.

The resulting braking force characteristic can also be configured according to requirements by means of the latching staging of the abutment element 19. The resulting braking force characteristic may, for example, run linearly, degressively, progressively, etc.

Those persons skilled in the art will thus recognize and understand that the invention is susceptible of broader utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, it is to be understood that the foregoing disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. Yarn brake for a two-for-one twisting spindle with a brake element mounted in the region of a hollow axle of a spindle between an upper and a lower brake face, the braking force being predeterminable in a defined manner by means of the pretensioning of at least one spring element, which acts on an axially displaceably mounted upper piston, in which the upper brake face is integrated, and the yarn brake being pneumatically releasable to introduce a yarn, characterised in that the upper piston (27) receiving the upper brake face (28) is configured in such a way and guided with play (S) within a housing (16) of the yarn brake (14) in such a way that it can move aside if necessary into a position (I), in which its center longitudinal axis (37) forms an angle ($\alpha$) with the center longitudinal axis (38) of the housing (16).

2. Yarn brake according to claim 1, characterised in that an angle (cc) which is up to 10°, is adjusted in the position (I) between the center longitudinal axis (37) of the upper piston (27) and the center longitudinal axis (38) of the housing (16).

3. Yarn brake according to claim 1, characterised in that the upper piston (27) has a disc-shaped lower guide lug (25), the diameter (d) of which is below the internal diameter (D) of the housing (16) in the working region of the guide lug (25).

4. Yarn brake according to claim 1, characterised in that the upper piston (27) has a circular, upper guide lug (26), the internal diameter ($d_1$) of which is above the external diameter ($D_1$) of the hollow axle (5) of the spindle.

5. Yarn brake according to claim 3, characterised in that at least the lower guide lug (25) has a convexly curved, peripheral guide face (40).

6. Yarn brake according to claim 1, characterised in that the upper piston (27) is loaded by second and third spring elements (23, 24) arranged one behind the other, which have different spring characteristics.

7. Yarn brake according to claim 6, characterised in that the pretensioning of the spring elements (23, 24) can be adjusted by an abutment device (19), which is rotatably mounted within the housing (16) and has helically arranged latching positions (20).

8. Yarn brake according to claim 1, characterised in that the lower brake face (30) is integrated into a lower piston (31), which, during the twisting operation, loaded by at least one spring element (33), is positioned in a working position (A) and can be pneumatically lowered into a threading position (E) to thread a new yarn (3, 4).

9. Yarn brake according to claim 1, characterised in that arranged in the region of the brake element (29) is a support element (42), which is movably mounted to a limited extent in the axial direction and, during the twisting operation, is positioned by the lower piston (31) in a rest position (R) and which, during the lowering of the lower piston (31) into its threading position (E), slides into an intermediate position (Z), in which the brake element (29) is eccentrically positioned.

10. Yarn brake according to claim 9, characterised in that the support element (42) has an oblique plane (44), which ensures an eccentric positioning of the brake element (29).

11. Yarn brake according to claim 9, characterised in that the brake element (29) is mounted in a receiving pocket (45) of the lower piston (31) when the lower piston (31) is lowered.

12. Yarn brake according to claim 1, characterised in that installed in the region of the brake element (29) is a support element (42A) on which the brake element (29) rests when the lower piston (31) is lowered into its threading position (E), the support element (42A) being configured in such a way that even when the brake element (29) is resting thereon, a new yarn (3, 4) can be threaded.

13. Yarn brake according to claim 1, characterised in that the brake element (29) configured as a brake ball and/or the brake faces (28, 30) consist of an abrasion-resistant material.

14. Yarn brake according to claim 1, characterised in that the brake element (29) configured as a brake ball and/or the brake faces (28, 30) are manufactured from an oxide ceramic material.

15. Yarn brake according to claim 1, characterised in that the brake element (29) configured as a brake ball and/or the brake faces (28, 30) consist of hardened steel.

* * * * *